US006339684B1

(12) United States Patent
Sato et al.

(10) Patent No.: US 6,339,684 B1
(45) Date of Patent: Jan. 15, 2002

(54) RECORDING APPARATUS WHICH JUDGES WHETHER A PROPER CARTRIDGE IS ATTACHED THERETO

(75) Inventors: Tamotsu Sato, Komoro; Tatsuya Tamaru, Ueda, both of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/500,541

(22) Filed: Feb. 9, 2000

(30) Foreign Application Priority Data

May 14, 1999 (JP) ..... 11-133530

(51) Int. Cl.[7] ..... G03G 15/00
(52) U.S. Cl. ..... 399/12; 399/25
(58) Field of Search ..... 399/12, 13, 25, 399/27, 107, 111; 347/19, 152

(56) References Cited

U.S. PATENT DOCUMENTS 4,961,088 A * 10/1990 Gilliland et al. ..... 399/25
4,963,939 A * 10/1990 Kurando et al. ..... 399/12
4,994,853 A * 2/1991 Fukuchi et al. ..... 399/12
5,365,312 A * 11/1994 Hillmann et al. ..... 399/12
5,835,817 A * 11/1998 Bullock et al. ..... 399/25
6,144,812 A * 11/2000 Ueno ..... 399/12

* cited by examiner

*Primary Examiner*—Sandra Brase
(74) *Attorney, Agent, or Firm*—Greenblum & Bernstein, P.L.C.

(57) ABSTRACT

The recording apparatus of the present invention acquires time data from a clock built in the main body of the apparatus, and generates first calculation data by calculating the time data with a predetermined calculation method. Meanwhile, in the cartridge attached to the main body, the time data is acquired from the main body, and second calculation data is generated by calculating the time data with the same calculation method as the above-mentioned predetermined calculation method. As a result of comparing the first calculation data to the second calculation data, it is judged that the attached cartridge is proper when both of the data match, and it is judged that the attached cartridge is not proper when both of the data do not match. It is thereby possible to judge whether or not the cartridge attached to the main body is proper.

10 Claims, 5 Drawing Sheets

RECORDING APPARATUS WHICH JUDGES WHETHER A PROPER CARTRIDGE IS ATTACHED THERETO

BACKGROUND OF THE INVENTION

1. Field of the Invention

The present invention relates to a recording apparatus which judges whether a proper cartridge is attached thereto, process cartridge for use therein, cartridge judgement method, and image communication apparatus.

2. Description of the Related Art

Conventionally in recording apparatuses such as laser beam printers, since proper toners are limited depending on, for example, characteristics of photosensitive materials, it is judged whether or not an attached cartridge is proper. This judgement prevents image qualities from being provided with adverse effects caused by attaching an improper cartridge. As the above-described judgement, adopted is a method in which a main body of the recording apparatus reads an ID number incorporated into the cartridge to check up. As an example of the conventional recording apparatuses which judge the ID number, the laser beam printer is explained below.

FIG.1 is a schematic configuration diagram of a conventional laser beam printer. Conventional laser beam printer 500 is attachable and removal to/from a main body of the printer, and comprised of cartridge 502 into which fixed ID number 501 is incorporated, and main body 504 in which CPU 503 is mounted. When this cartridge 502 is attached to main body 504, CPU 503 of main body 504 reads ID number 501 incorporated into cartridge 502, and checks up the ID number. It is thus judged whether or not a proper cartridge is attached.

However in the conventional recording apparatus, since the ID number is fixed, the ID number is easy to copy, resulting in the problem that the cartridge can be imitated easily.

On the other hand, in order to prevent the ID number from being copied, there is a method for making the ID number variable, not fixed. However, to make the ID number variable, it is necessary to newly provide a special circuit such as a random number generation circuit. As a result, there are problems that the configuration of the recording apparatus becomes complicated, and that the cost thereof is increased.

SUMMARY OF THE INVENTION

An object of the present invention is to provide a recording apparatus capable of holding an ID number at the secret state, by making the ID number of a cartridge variable without adding large changes to a configuration of a conventional recording apparatus, a process cartridge for use in the recording apparatus, cartridge judgement method, and image communication apparatus.

The recording apparatus of the present invention acquires time data from a clock built in a main body of the apparatus, and generates first calculation data by calculating the time data with a predetermined calculation method. Meanwhile, in the cartridge attached to the main body, the time data is acquired from the main body, and second calculation data is generated by calculating the time data with the same calculation method as the above-mentioned predetermined calculation method. Then, as a result of comparing the first calculation data to the second calculation data, it is judged that the attached cartridge is proper when both of the data match, and it is judged that the attached cartridge is not proper when both of the data do not match.

Thus, the recording apparatus of the present invention employs the time data that is conventionally provided, and checks up the data acquired with the same algorithm by a CPU of the main body and another CPU at an IC card side. It is thereby possible to judge whether or not the cartridge attached to the main body is proper. As a result, it is possible to prevent the deterioration of image qualities caused by using an improper cartridge, and to always provide high image qualities to users. Further, since the recording apparatus of the present invention employs the time data acquired from the clock conventionally provided therein, it is possible to make the ID number variable without adding large changes to the configuration of the conventional recording apparatus.

BRIEF DESCRIPTION OF THE DRAWINGS

The above and other objects and features of the invention will appear more fully hereinafter from a consideration of the following description taken in connection with the accompanying drawing wherein one example it illustrated by way of example, in which.

DETAILED DESCRIPTION OF THE PREFERRED EMBODIMENT

An embodiment of the present invention is described below with reference to accompanying drawings.

Figure 1:
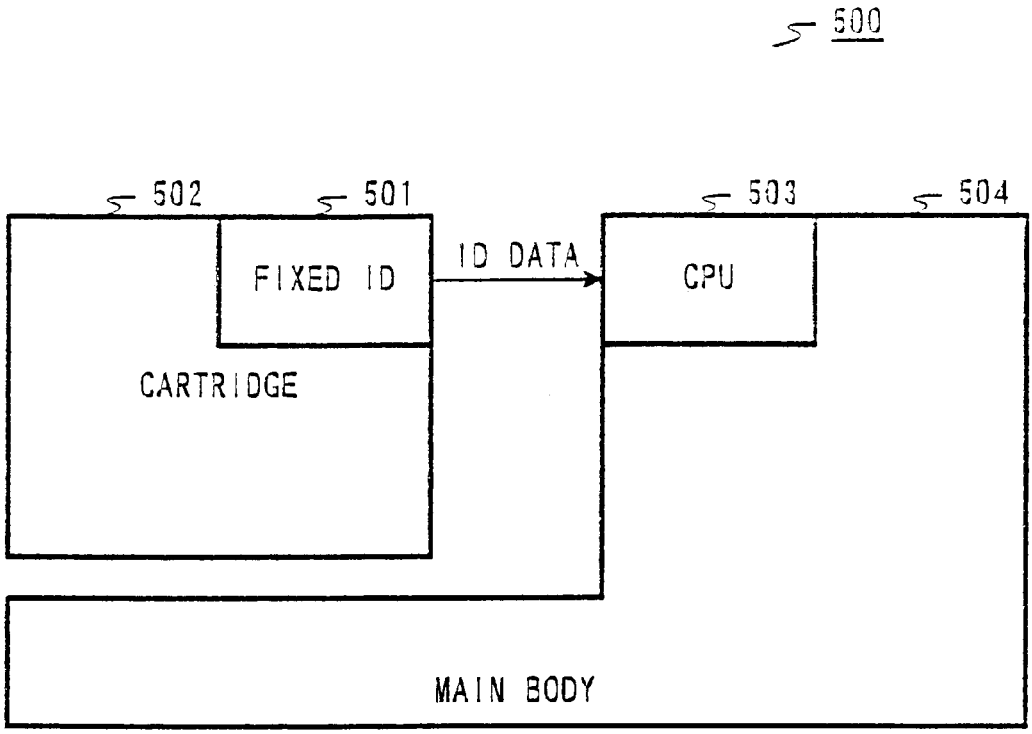
FIG. 1 PRIOR ART
FIG. 1 is a schematic configuration diagram of a conventional laser beam printer.
Figure 2:
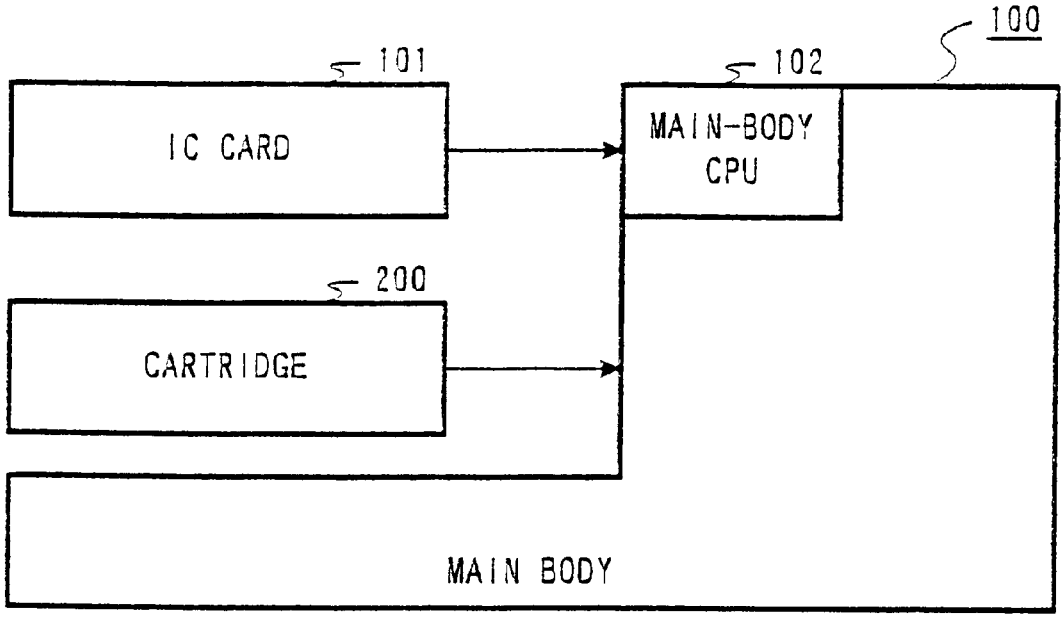
FIG. 2 is a diagram illustrating a schematic configuration of a recording apparatus according to an embodiment of the present invention.

FIG. 2 is a schematic configuration diagram of a recording apparatus according to the embodiment of the present invention. The recording apparatus according to the embodiment of the present invention is comprised of main body 100, cartridge 200 which is attached to main body 100 and filled with toners, and IC card 101 for use in judging whether or not the attached cartridge 200 is proper cartridge 200. IC card 101 is judged by CPU 102 that is provided in main body 100 (hereinafter referred to as main-body CPU 102).

In the recording apparatus, by the use of IC card 101 provided separately from cartridge 200, it is judged whether or not attached cartridge 200 is proper. Accordingly, the recording apparatus does not operate when cartridge 200 is only attached to main body 100, and becomes capable of operating when cartridge 200 and IC card 101 are attached to main body 100. In addition, it may be possible that IC card 101 is built in cartridge 200 as one body.

Figure 3:
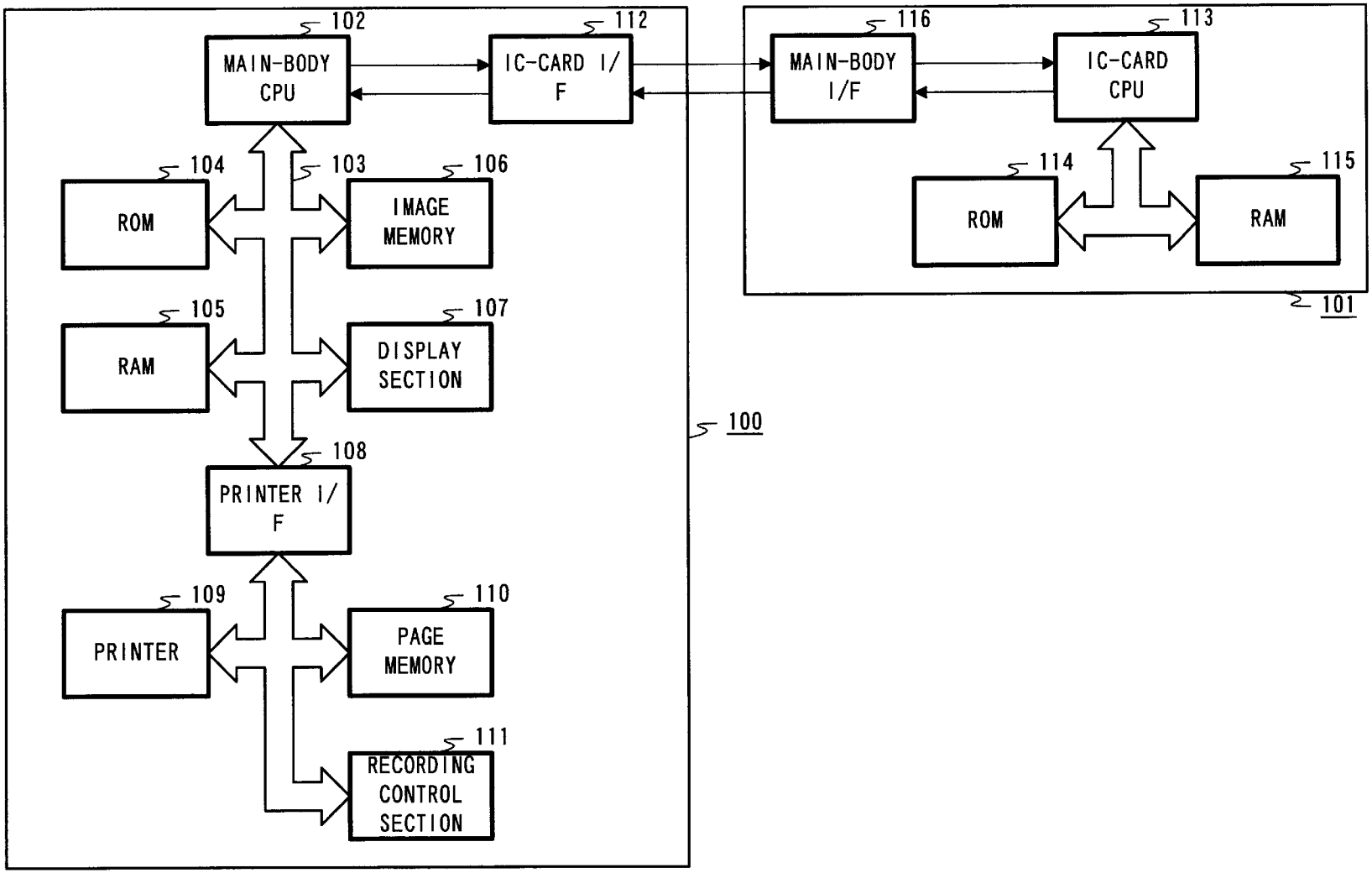
FIG. 3 is a schematic block diagram of the recording apparatus according to the above embodiment.

FIG. 3 is a block diagram illustrating a schematic configuration of the recording apparatus.

In main body 100 of the recording apparatus, main-body CPU 102 controls ROM 104, RAM 105, image memory 106 and display section 107, which are connected with bus 103. ROM 104 stores various programs for use by main-body CPU 102 to operate, while storing a program for use in a judgement of ID number that will be described later. RAM 105 is used as an area for operations of main-body CPU 102. Image memory 106 stores image data to be recorded. Display section 107 displays a current state of the recording apparatus and set state therein.

Printer I/F 108 is an interface used for main-body CPU 102 to control printer 109. Printer 109 forms an image on recording paper being given toners supplied from cartridge 200. Page memory 110 spools image data when printer 109 records. Recording control section 111 controls recording operations of printer 109. In addition, main-body CPU 102 transmits and receives data from/to IC card through IC-card I/F 112.

MIn IC card 101, CPU 113 provided in IC card 101 (hereinafter referred to as IC-card CPU) executes a program stored in ROM 114. At this time, IC-card CPU 113 uses RAM 115 as an area to operate. Further, IC-card CPU 113 transmits and receives data to/from main body 100 through main-body I/F 116.

Figure 4:
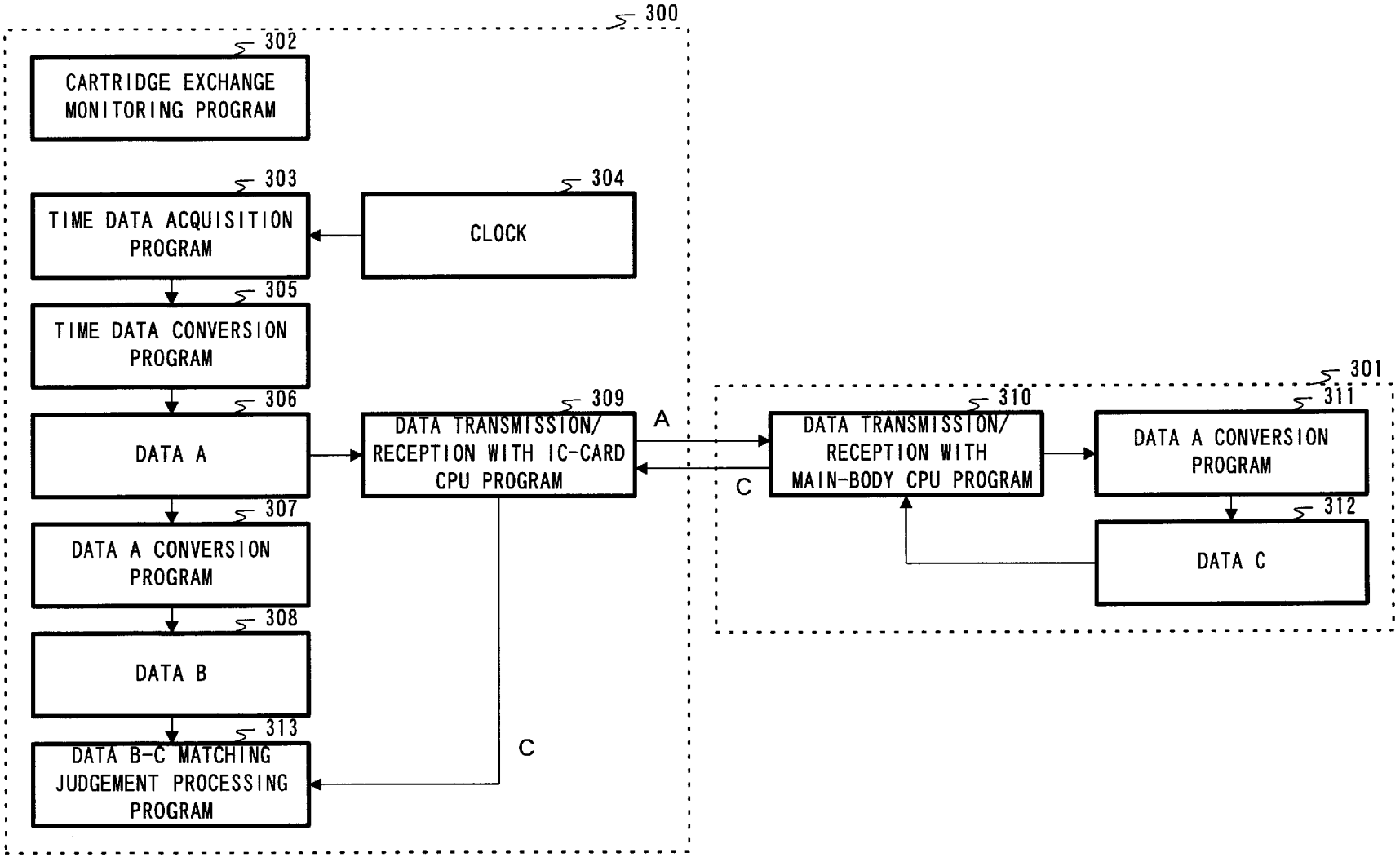
FIG. 4 is a diagram illustrating a program structure in the recording apparatus according to the above embodiment.

FIG. 4 is a diagram illustrating a program structure in the recording apparatus.

Program 300 is a program executed by main-body CPU 102. Program 301 is a program executed by IC-card CPU 113. Program 300 is provided with cartridge exchange monitoring program 302 to monitor the attachment of cartridge 200. Cartridge exchange monitoring program 302 is a program to periodically monitor whether or not cartridge 200 is exchanged in main body 100.

Further, time data acquisition program 303 is a program to acquire time data from clock 304. The time data, acquired by the execution of time data acquisition program 303, is converted into data A 306 by the execution of time data conversion program 305. Data A 306 is converted into data B 308 by the execution of data A conversion program 307. Data B 308 is provided to data B-C matching judgment processing program 313 which will be described later.

Meanwhile, data A 306 is transmitted to IC-card CPU 113 by the execution of data transmission/reception with IC-card CPU 113 program 309. Transmitted data A 306 is converted into data C 312 by the execution of data A conversion program 311. Data C 312 is transmitted to main-body CPU 102 by the execution of data transmission/reception with main-body CPU 102 program 310. Transmitted data C 312 is provided to data B-C matching judgement processing program 313. By the execution of data B-C matching judgement processing program 313, it is judged whether or not data B 308 matches data C 312.

Figure 5:
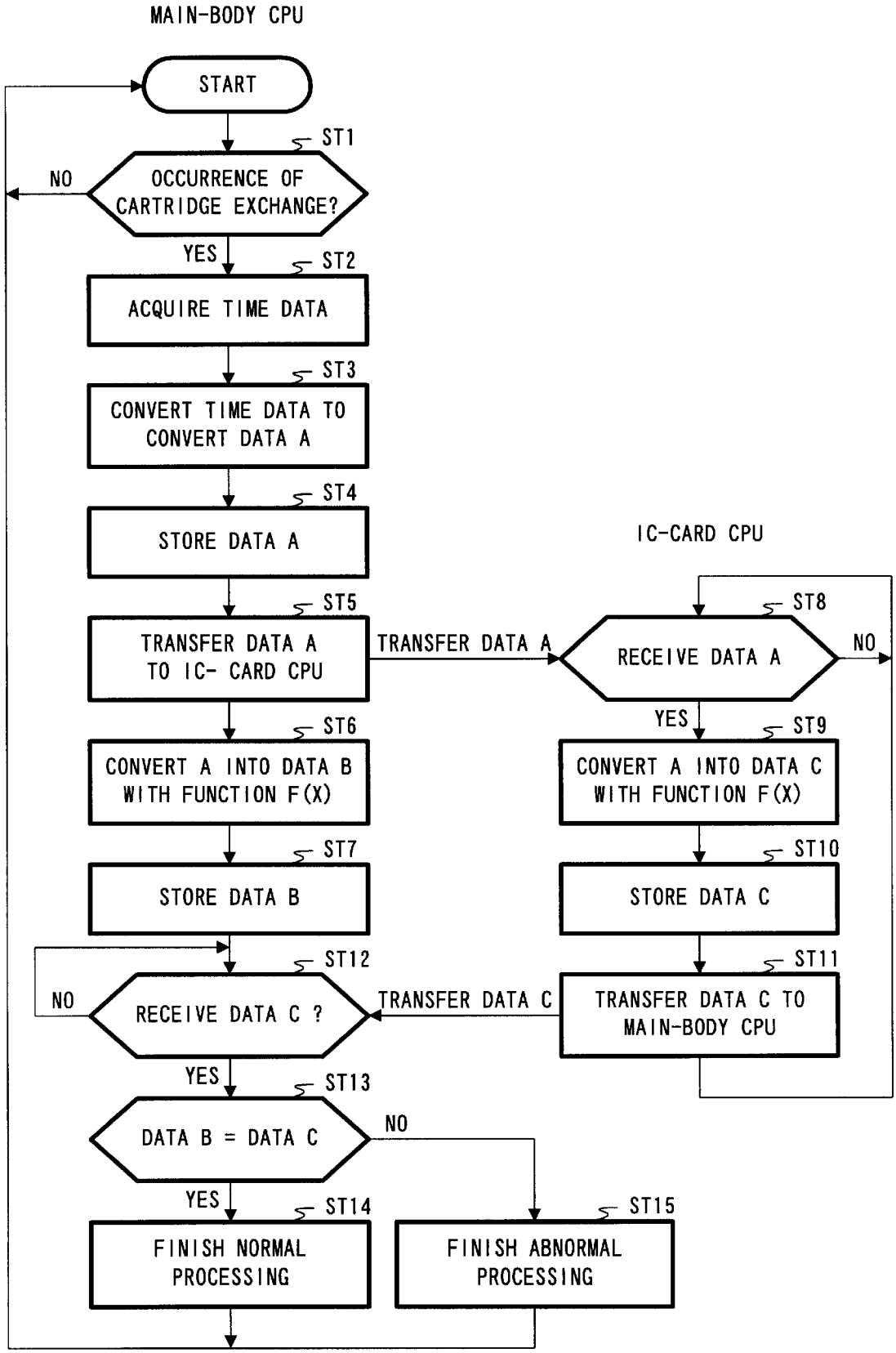
FIG. 5 is an operation flowchart for the recording apparatus according to the above embodiment.

Operations of the recording apparatus configured as described above are next explained. FIG. 5 is a diagram illustrating an operation flowchart for the recording apparatus.

Main-body CPU 12 periodically monitors whether or not cartridge 200 is exchanged by executing cartridge exchange monitoring program 302.

When cartridge 200 is attached (ST1), in order to judge the cartridge 200 is proper cartridge 200, main-body CPU 102 acquires time data by executing time data acquisition program 303 (ST2). At this point, main-body CPU 102 also judges whether or not IC card 101 is attached to main body 100. At this stage, in the case where IC card 101 is not attached, main-body CPU 102 prohibits a recording operation of the recording apparatus even when cartridge 200 is attached to main body 100.

Next, main-body CPU 102 converts the time data into data A 306 by executing time data conversion program 305 (ST3). Main-body CPU 102 stores converted data A 306 in RAM 105 (ST4).

Further, main-body CPU 102 reads out data A 306 from RAM 105. Then by executing data transmission/reception with IC-card CPU 113 program 309, main-body CPU 102 transmits data A 306 to IC-card CPU 113 (ST5).

In parallel with the above-described operations, main-body CPU 102 converts data A 306 into data B 308 by executing data A conversion program 307. Specifically, main-body CPU 102 converts data A 306 into data B 308 using a specific function f(x) (ST6). Main-body CPU 102 stores converted data B 308 in RAM 105 (ST7).

Meanwhile, IC-card CPU 113 periodically monitors whether or not data A 306 transmitted at ST5 is received. When data A 306 is received (ST8), IC-card CPU 113 converts data A 306 into data C 312 by executing data A conversion program 311. Specifically, IC-card CPU 113 converts data A 306 into data C 312 using the function f(x) used at ST6 (ST9). IC-card CPU 113 stores converted data C 312 in RAM 115 (ST10).

Next, IC-card CPU 113 reads out data C 312 from RAM 115. IC-card CPU 113 transfers data C 312 to main-body CPU 102 by executing data transmission/reception with main-body CPU 102 program 310 (ST11).

After executing the processing of ST7, main-body CPU 102 periodically monitors whether or not data C 312 is received form IC-card CPU 113. When data C 312 is received (ST12), main-body CPU 102 judges whether or not data B 308 is equal to data C 312 by executing data B-C matching judgement processing program 313 (ST13). As a result of the judgement, when both data are equal, main-body CPU 102 judges that IC card attached to main body 100 is proper. Main-body CPU 102 judges thereby that cartridge 200 attached to main body 100 is also proper. Then, main-body CPU 102 enables the execution of recording operations with cartridge 200 (ST14).

On the other hand, as a result of the judgment at ST13, when both data are not equal, main-body CPU 102 judges that IC card 101 attached to main body 100 is not proper. By this judgment, even when cartridge 200 is attached to main body 100, main-body CPU 102 judges that the cartridge 200 is not proper. Then, main-body CPU 102 prohibits the recording operation with cartridge 200 (ST15).

Thus, the recording apparatus employs the time data that is conventionally provided, and checks up the data acquired with the same algorithm by the main-body CPU and the CPU at the IC card side. It is thereby possible to judge whether or not the cartridge attached to the main body is proper. As a result, it is possible to prevent the deterioration of image qualities caused by using an improper cartridge, and to always provide high image qualities to users. Further, since the recording apparatus of the present invention employs the time data acquired from the clock conventionally provided therein, it is possible to make the ID number variable without adding large changes to the configuration of the conventional recording apparatus.

In addition, the recording apparatus in this embodiment employs the time data from the clock that is conventionally provided therein, and checks up the data acquired with the same algorithm by main-body CPU 102 and IC-card CPU 113. However, the data is not limited to the time data from the clock, and it may be possible to employ data other than the time data. In the case where the data other than the time data is employed, although it is preferable to employ variable data, it may be possible to employ fixed data.

In the case where the variable data is employed, instead of the use of the time data from the clock in this embodiment, it is considered that, for example, a random number generation circuit is provided, and data generated therein is used. In this case, although a newly configuration is added to the conventional configuration, it may be possible to judge whether or not a cartridge attached to the recording apparatus is a proper cartridge, and also to achieve the effect for making the ID number variable.

Even in the case where the fixed data is employed, since main-body CPU 102 and IC-card CPU 113 both acquire data using the same specific algorithm, it is possible to achieve the effect for judging whether or not the cartridge attached to the recording apparatus is a proper cartridge.

Further, the recording apparatus of this embodiment judges whether the attached cartridge is a proper cartridge. However, the object to be judged is not limited to the cartridge, and is applicable to any part, of which the correct one is required when being used in the recording apparatus.

As described above, the recording apparatus employs the time data that is conventionally provided, and checks up the data acquired with the same algorithm by the main-body CPU and the CPU at the IC card side. It is thereby possible to judge whether or not the cartridge attached to the main body is proper. As a result, it is possible to prevent the deterioration of image qualities caused by using an improper cartridge, and to always provide high image qualities to users. Further, in the present invention, since the time data acquired from the clock conventionally provided in the recording apparatus is employed, it is possible to make the ID number variable without adding large changes to the configuration of the conventional recording apparatus.

The present invention is not limited to the above described embodiments, and various variations and modifications may be possible without departing from the scope of the present invention.

This application is based on the Japanese Patent Application No.HEI11-133530 filed on May 14, 1999, entire content of which is expressly incorporated by reference herein.

What is claimed is:

1. A recording apparatus provided with a cartridge for supplying a toner, said cartridge being attachable and removal to/from said apparatus, comprising:

a recording unit which forms an image with the toner supplied from the cartridge attached to said recording apparatus;

a data generator which generates first data for use in judging whether or not the cartridge attached to said recording apparatus is a proper cartridge;

a first processor which calculates said first data with a predetermined calculation method to obtain second data; and an IC card provided in said recording apparatus, said IC card being attachable and removal to/from said apparatus, and having second processor which calculates said first data with the same method as said predetermined calculation method to obtain third data, in order to judge whether or not the cartridge attached to said recording apparatus is the proper cartridge, mwherein said first processor judges that the cartridge attached to said recording apparatus is the proper cartridge when said second data and said third data match.

2. The recording apparatus according to claim 1, wherein in the case where said IC card is attached to said recording apparatus, and said second data and said third data match, said first processor judges that the cartridge attached to said recording apparatus is the proper cartridge, and enables said recording unit to operate to form an image with the cartridge attached to said recording apparatus.

3. The recording apparatus according to claim 2, wherein in the case where said IC card is attached to said recording apparatus, and said second data and said third data do not match, said first processor judges that the cartridge attached to said recording apparatus is not the proper cartridge, and prohibits said recording unit from operating to form the image with the cartridge attached to said recording apparatus.

4. The recording apparatus according to claim 1, wherein said data generator generates data that varies at all times as said first data.

5. The recording apparatus according to claim 4, wherein said data generator is a timer which manages time data of said recording apparatus.

6. The recording apparatus according to claim 1, wherein said IC card is incorporated into the cartridge to be attached to said recording apparatus.

7. The recording apparatus according to claim 1, wherein the cartridge to be attached to said recording apparatus is a process cartridge which supplies toners for use in a step of forming an image with a plurality of colors.

8. An image communication apparatus provided with a cartridge for supplying a toner, said cartridge being attachable and removal to/from said apparatus, comprising:

a scanner which scans an image;

a communication unit which transmits an image scanned by said scanner via a communication channel, while receiving an image via said communication channel;

a recording unit which forms the image received by said communication unit with the toner supplied from the cartridge attached to said image communication apparatus;

a data generator which generates first data for use in judging whether or not the cartridge attached to said image communication apparatus is a proper cartridge;

a first processor which calculates said first data with a predetermined calculation method to obtain second data; and an IC card provided in said image communication apparatus, said IC card being attachable and removal to/from said apparatus, and having second processor which calculates said first data with the same method as said predetermined calculation method to obtain third data, in order to judge whether or not the cartridge attached to said image communication apparatus is the proper cartridge, wherein said first processor judges that the cartridge attached to said image communication apparatus is the proper cartridge when said second data and said third data match.

9. A recording apparatus which requires a proper attachment to be attached, comprising:

a recording unit which forms an image;

a data generator which generates first data for use in judging whether or not the attachment attached to said recording apparatus is a proper attachment;

a first processor which calculates said first data with a predetermined calculation method to obtain second data; and an IC card provided in said recording apparatus, said IC card being attachable and removal to/from said apparatus, and having second processor which calculates said first data with the same method as said predetermined calculation method to obtain third data, in order to judge whether or not the attachment attached to said recording apparatus is the proper attachment, wherein said first processor judges that the attachment attached to said recording apparatus is the proper attachment when said second data and said third data match.

10. A method of judging whether or not a cartridge attached to a recording apparatus is a proper cartridge, said method comprising:

generating first data for use in judging whether or not a cartridge is a proper cartridge when said cartridge is attached to said recording apparatus;

calculating said first data with a predetermined calculation method in first processor provided in said recording apparatus to obtain second data;

calculating said first data with the same method as said predetermined calculation method in second processor provided in an IC card attached to said recording apparatus to obtain third data, and comparing said second data to said third data in said first processor, and judges that the cartridge attached to said recording apparatus is the proper cartridge when said second data and said third data match, while judging that the cartridge attached to said recording apparatus is not the proper cartridge when said second data and said third data do not match.

* * * * *

UNITED STATES PATENT AND TRADEMARK OFFICE

CERTIFICATE OF CORRECTION

PATENT NO. : 6,339,684 B1
DATED : January 15, 2002
INVENTOR(S) : T. Sato et al.

It is certified that error appears in the above-identified patent and that said Letters Patent is hereby corrected as shown below:

Column 5,
Line 60, “mwherein” should be -- wherein --.

Signed and Sealed this

Fifteenth Day of October, 2002

*Attest:*

*Attesting Officer*

JAMES E. ROGAN
*Director of the United States Patent and Trademark Office*